United States Patent [19]

Mohrhoff

[11] 3,979,933

[45] Sept. 14, 1976

[54] FUEL TANK FILLER CAP LOCK

[75] Inventor: Jack Mohrhoff, Jersey City, N.J.

[73] Assignee: The Raymond Lee Organization, Inc., New York, N.Y. ; a part interest

[22] Filed: Sept. 15, 1975

[21] Appl. No.: 613,128

[52] U.S. Cl. ..... 70/164; 70/53

[51] Int. Cl.[2] ..... B65D 55/14; E05B 65/02

[58] Field of Search ..... 70/163, 164, 53; 138/89; 220/55, 210

[56] References Cited

UNITED STATES PATENTS

| | | | |
|---|---|---|---|
| 1,097,081 | 5/1915 | Coon | 70/53 X |
| 1,288,905 | 12/1918 | Isom | 70/53 X |
| 1,747,202 | 2/1930 | White | 70/164 |
| 1,778,502 | 10/1930 | Levey | 220/210 X |
| 1,989,300 | 1/1935 | Webb | 70/164 X |
| 3,636,739 | 1/1972 | Smedley | 70/53 |
| 3,738,137 | 6/1973 | Jones | 70/53 X |

FOREIGN PATENTS OR APPLICATIONS

| | | | |
|---|---|---|---|
| 415,356 | 6/1925 | Germany | 220/210 |

*Primary Examiner*—J. Franklin Foss

[57] ABSTRACT

A clamp encircles the filler pipe of a fuel tank below the filler cap. Two like diametrically opposed standards extend upwardly above the cap. Loops on the standards accommodate an elongated U-shaped removable shackle of a padlock to be secured between the standards, directly above the cap.

3 Claims, 3 Drawing Figures

FIG. 1
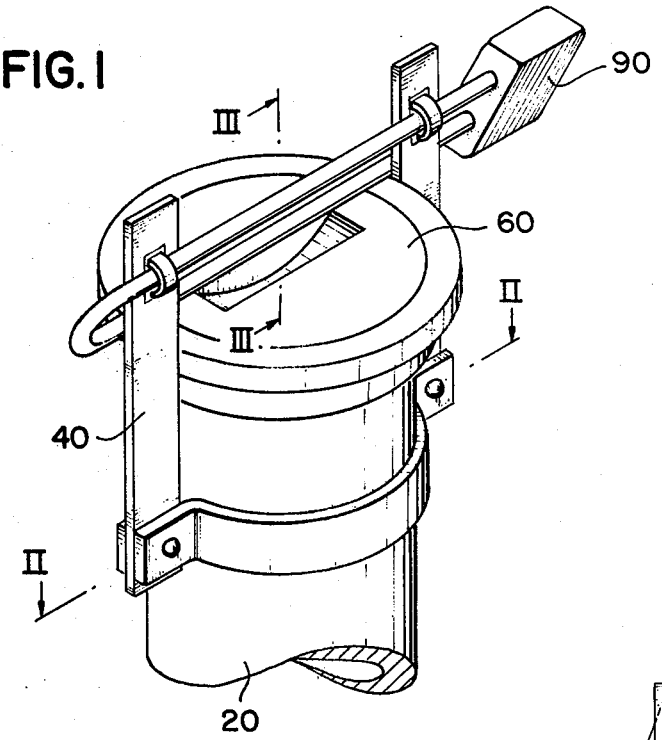
FIG. 3
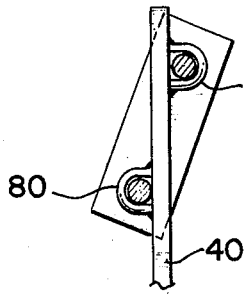
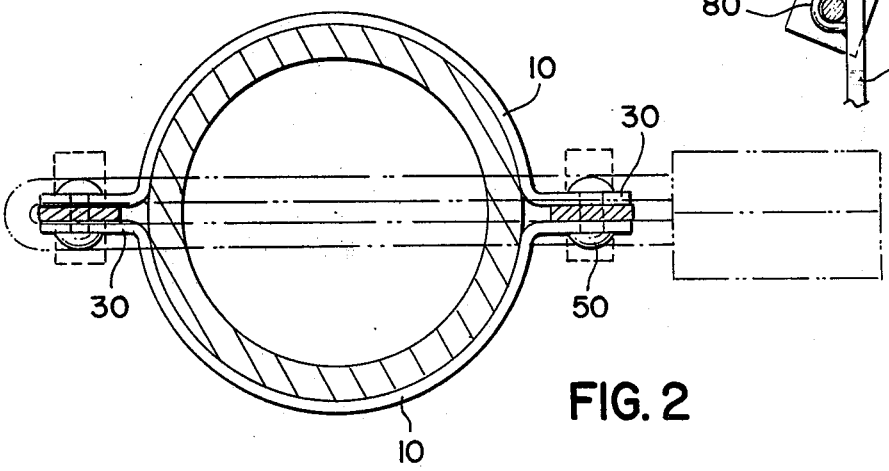
FIG. 2

FUEL TANK FILLER CAP LOCK

SUMMARY OF THE INVENTION

This invention is a device that is designed to prevent filler caps being removed from the tops of fuel tank filler pipes of the type used in private residences and office buildings. In this invention, a padlock having an elongated, U-shaped, removable shackle is employed and is suspended by a suitable structure above the filler cap. The filler cap thus cannot be removed from the filler pipe because it is blocked by the shackle, and the fuel in the fuel tank cannot be stolen by pumping it out via a tube inserted into the tank via the filler pipe.

BRIEF DESCRIPTION OF THE DRAWINGS

FIG. 1 shows the invention in use.

FIG. 2 is a view along line II—II in FIG. 1.

FIG. 3 is a view along line III—III in FIG. 1.

DETAILED DESCRIPTION OF PREFERRED EMBODIMENTS

Two strips of metal 10 are bent into opposed semicircles to encircle a filler pipe 20 of the sort used in private homes and residences. The strips have radially outwardly extending tabs 30, and a flat vertical standard 40 is sandwiched between each pair of corresponding tabs. Rivets 50 extending between each pair of corresponding tabs secures the strips 10 around the pipe to form a clamp and holds the standards in a parallel, diametrically opposed relationship.

A filler cap 60 is secured to the top of the pipe above the clamp. It is to be noted that the cap is wider than the pipe, preventing the clamp from being slid off the top of the pipe when the cap is installed. The standards extend above the top of the cap.

Each standard is a flat strip of metal, and each bears two loops: an upper loop 70 facing in one direction on one side and a lower loop 80 facing in the other direction on the other side. The upper loops and lower loops are aligned.

A conventional bicycle lock 90 has an elongated, removable U-shaped shackle. As shown in the figures, the shackle can be inserted in the loops to straddle the standards while extending transversely between them directly above the cap. After the lock is reattached to the shackle, the cap cannot be removed without breaking either the clamp or the lock or the standards. Theft of fuel oil thus is made more difficult.

While the invention has been described with particular reference to the drawings, the protection sought is to be limited only by the terms of the claims which follow.

What is claimed is:

1. A fuel tank filler cap lock, comprising:

a clamp encirclng a fuel tank filler pipe below the filler cap;

two like diametrically opposed flat standards attached to the clamp and extending vertically upwardly from the clamp to a point above the filler cap; and a plurality of loops attached to the standards above the cap in a manner that the shackle of a conventional bicycle lock with a removable U-shaped shackle may be passed through the loops and thereby maintained to extend transversely between the standards directly above the cap, each standard having an upper loop on one side and a lower loop on the other side with corresponding loops on the standard being aligned to cause the shackle to straddle both sides of the standards.

2. The device of claim 1 further comprising a conventional bicycle lock with a removable U-shaped shackle.

3. The device of claim 2 wherein the cap is wider than the pipe.

* * * * *